US007118607B2

(12) United States Patent
Bott et al.

(10) Patent No.: US 7,118,607 B2
(45) Date of Patent: Oct. 10, 2006

(54) FILTER STOP FOR A VACUUM CLEANER

(75) Inventors: Erich Bott, Hollstadt (DE); Roland Illig, Heustreu (DE); Wolfgang Kemmerzell, Gersfeld (DE); Albert Kleinhenz, Burgwallbach (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/873,404

(22) Filed: Jun. 21, 2004

(65) Prior Publication Data

US 2005/0000195 A1 Jan. 6, 2005

Related U.S. Application Data

(63) Continuation of application No. PCT/EP02/13527, filed on Nov. 29, 2002.

(30) Foreign Application Priority Data

Dec. 21, 2001 (DE) ..... 101 63 525

(51) Int. Cl.
*B01D 46/00* (2006.01)

(52) U.S. Cl. ..... 55/374; 55/375; 55/377; 55/378; 55/DIG. 2; 15/349; 15/351; 15/352; 15/339

(58) Field of Classification Search ..... 55/374, 55/375, 377, 378, DIG. 2, DIG. 3; 15/349, 15/351, 352, 339
See application file for complete search history.

(56) References Cited

U.S. PATENT DOCUMENTS

| | | | | |
|---|---|---|---|---|
| 4,678,486 A | | 7/1987 | Jacob et al. | |
| 5,028,245 A | | 7/1991 | Stein et al. | |
| 5,089,038 A | * | 2/1992 | Kopco et al. | 55/374 |
| 5,092,915 A | * | 3/1992 | Lackner | 55/375 |
| 5,940,931 A | * | 8/1999 | Jeon | 15/339 |

FOREIGN PATENT DOCUMENTS

| | | |
|---|---|---|
| DE | 34 07 658 A1 | 9/1985 |
| DE | 40 13 572 A1 | 11/1990 |
| DE | 39 20 313 A1 | 1/1991 |
| DE | 40 40 099 A1 | 6/1992 |
| EP | 0 279 793 A1 | 8/1988 |
| EP | 0 396 864 A1 | 11/1990 |
| JP | 09187406 A | 7/1997 |

* cited by examiner

*Primary Examiner*—Minh-Chau T. Pham
(74) *Attorney, Agent, or Firm*—John T. Winburn; Russell W. Warnock; Craig J. Loest

(57) ABSTRACT

A filter stop for a vacuum cleaner contains a dust chamber that is closable with a lid and receives a dust bag with a reinforcement plate in a specific fitting position. The filter stop has a base plate that is movable between two stopping positions parallel to the direction in which the reinforcement plate of the dust bag is inserted into the dust chamber. The filter stop is also provided with a swiveling lever that can be brought into a position activating the vacuuming function of the vacuum cleaner by the reinforcement plate when the dust bag is correctly positioned. The swiveling lever is in a position preventing the vacuuming function from being activated when the dust bag is not correctly positioned. The filter stop can be brought into a stop position activating the vacuuming function exclusively when the swiveling lever is actuated by a shoulder of the reinforcement plate.

22 Claims, 5 Drawing Sheets

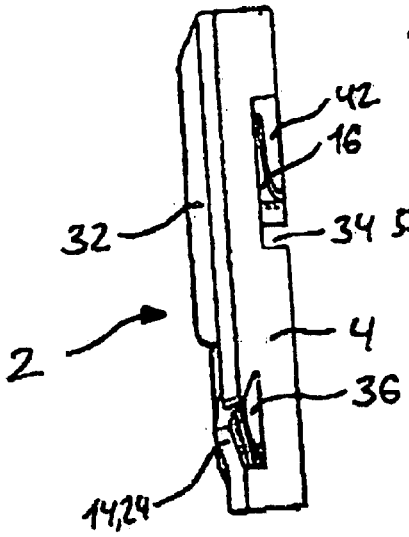
FIG. 2A
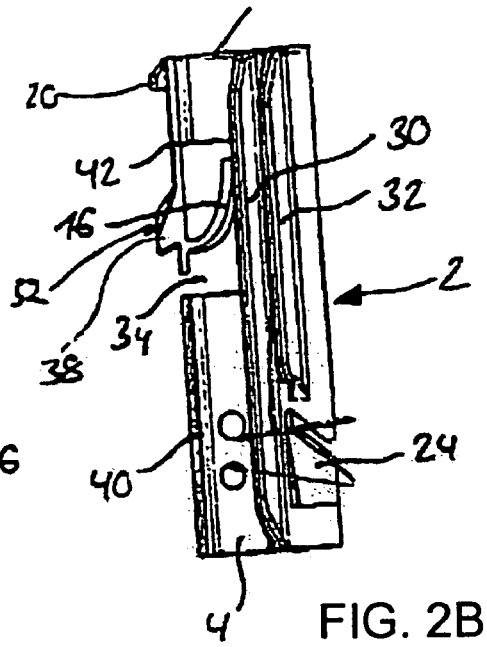
FIG. 2B
FIG. 3A
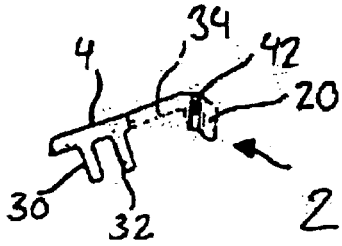
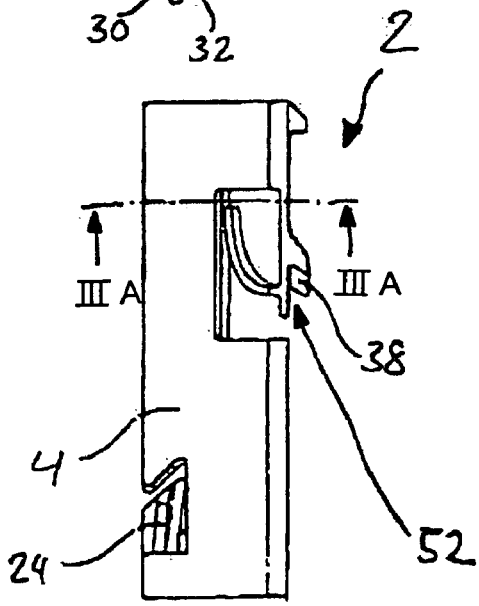
FIG. 3B

FILTER STOP FOR A VACUUM CLEANER

CROSS-REFERENCE TO RELATED APPLICATION

This application is a continuation, under 35 U.S.C. § 120, of copending international application No. PCT/EP02/13527, filed Nov. 29, 2002, which designated the United States; this application also claims the priority, under 35 U.S.C. § 119, of German patent application No. 101 63 525.7, filed Dec. 21, 2001; the prior applications are herewith incorporated by reference in their entirety.

BACKGROUND OF THE INVENTION

FIELD OF THE INVENTION

The invention relates to a filter stop for a vacuum cleaner having a dust chamber that can be closed by a cover and is intended for accommodating a dust-retention device with a reinforcement plate in a defined installation position. The filter stop contains a base plate which can be displaced between two stop positions, parallel to a pushing-in direction of the reinforcement plate of the dust-retention device, and on which a pivoting lever is disposed.

Known electric vacuum cleaners are usually provided with filter bags made of fabric, paper or paper-fabric, in which the dirt that is taken in is collected and retained. Such a filter bag of the generic type and the way in which it is secured in the vacuum cleaner can be gathered, for example, from Published, European Patent Application EP 0 396 864 A1, corresponding to U.S. Pat. No. 5,028,245. A further vacuum cleaner with a retaining device for a filter bag of the generic type is also known from German Patent DE 40 40 099 C2. The retaining device here is disposed on a removable cover that closes the dust chamber. The filter bag can be fastened on the retaining device by a rigid retaining plate, as a result of which an inlet opening located in the retaining plate can be connected to an intake connector of the vacuum cleaner.

In the case of these known devices, it is possible for the filter bag, in unfavorable circumstances, to be inserted incorrectly or forgotten altogether. In the case of a filter bag being inserted incorrectly or being absent, there is a risk of the dirt that is taken in, in particular fluff and threads, passing into the motor fan and resulting in damage there. In addition, a dirt-filled bag-accommodating chamber in the vacuum cleaner is very difficult to empty and to clean. In order to avoid these problems, various embodiments of filter stops are known, these embodiments essentially all being based on preventing the start-up of the fan motor in the case of the filter bag being inserted incorrectly or being absent, or else on preventing closure of the flap of the filter-bag-accommodating chamber.

Published, Non-Prosecuted German Patent Application DE 34 07 658 A1 discloses a filter stop on a vacuum cleaner that contains a lever that is disposed on the vacuum-cleaner housing and can be pivoted by the spring force into the closing path of a cover which closes the dust chamber. This lever is interlocked in an opening located on the reinforcement plate of the filter bag and is thus retained outside the closing path. The filter stop is actuated in that the lever is disposed on the suction-connector-containing front wall of the dust chamber and the reinforcement plate has a vertical incision into which the lever can be pivoted by hand. In the case of the dust bag being absent or being positioned incorrectly, the cover that closes the dust chamber cannot be completely closed or latched in.

A further vacuum-cleaner filter stop of the generic type which only allows a vacuuming function of the vacuum cleaner when the filter bag has been positioned correctly in the guide elements via its filter-bag flange is known from Published, Non-Prosecuted German Patent Application DE 39 20 313 A1. By virtue of the filter bag positioned in the guide elements, an actuating element can be moved out of a position in which the vacuum function of the vacuum cleaner is prevented into a position in which the vacuum function is released. In the case of this filter stop, the guide elements and the filter-bag flange are matched to one another, with the result that the actuating element can only release the vacuum function when the filter bag is positioned correctly.

Finally, German Patent DE 40 13 572 C2 discloses a filter stop of the generic type. The vacuum cleaner described in this document has a blocking member that is configured as a single-part slide and can be moved in the direction of the adjustment path of a cover for the dust-bag chamber. The blocking member engages with the cover and is pushed in the direction of the cover, and into a blocking position, by a spring, an inserted reinforcement plate of the dust bag moving the blocking member out of the blocking position. In the case of the reinforcement plate being absent, the closure of the cover is thus blocked by the blocking member, with the result that it is difficult for incorrect operation of the vacuum cleaner without a filter bag to take place.

SUMMARY OF THE INVENTION

It is accordingly an object of the invention to provide a filter stop for a vacuum cleaner which overcomes the above-mentioned disadvantages of the prior art devices of this general type, which can prevent operation in the case of the dust bag being positioned incorrectly or being absent.

With the foregoing and other objects in view there is provided, in accordance with the invention, a filter stop for a vacuum cleaner having a dust chamber which can be closed by a cover and intended for accommodating a dust-retention device with a reinforcement plate in a defined installation position. The filter stop contains a base plate to be displaced between two stop positions, parallel to a pushing-in direction of the reinforcement plate of the dust-retention device. The base plate has a pivoting lever. The pivoting lever can be pivoted, by a shoulder of the reinforcement plate of the dust-retention device disposed at a correct installation position, into a first stop position of the two stop positions. Placement at the first stop position allows a vacuuming-function-releasing stop position of the base plate to be reached, and, with the dust-retention device disposed outside the correct installation position, the pivoting lever is disposed in a position which prevents the first stop position of the base plate from being reached.

According to the invention, it is possible for the filter stop to be used not just in conjunction with a dust bag, but also in conjunction with any other device for retaining the dust or the dirt, that is say also a dust separator or a cyclone.

Accordingly, the filter stop for the vacuum cleaner which has a dust chamber which can be closed by a cover and is intended for accommodating a dust bag with the reinforcement plate in a defined installation position contains a plate which can be displaced between at least two stop positions, parallel to the pushing-in direction of the reinforcement plate of the dust bag, and also contains a pivoting lever. With the dust bag located in the correct installation position, the pivoting lever is located in a position in which the vacuuming function of the vacuum cleaner is released or allowed. With the dust bag located outside the correct installation position, the pivoting lever is located in a position in which the vacuuming function is prevented.

According to the invention, the filter stop can only be moved into a first stop position, in which the vacuuming function of the vacuum cleaner is allowed, when the pivoting lever is actuated or pushed by a shoulder of the reinforcement plate. The filter stop according to the invention is associated with the advantage of operation of the vacuum cleaner without the dust bag, or with an incorrectly positioned dust bag, being reliably prevented, in that the filter stop can only be located in a first stop position when the reinforcement plate of the dust bag is in its envisaged installation location.

According to a first embodiment of the invention, if the dust bag is absent or has not been pushed all the way in, the filter stop is blocked in a second stop position, in which the vacuuming function of the vacuum cleaner is prevented. The filter stop can only be displaced between these two stop positions when the dust bag is placed in position.

A further aspect of the invention makes it possible for the cover of the dust chamber to be closed exclusively when the dust bag is placed in position, the filter stop, according to the invention, being located in the first stop position. This gives a clear signal to any operator that the dust bag has either been positioned incorrectly or is even absent. It is only in these cases that the cover of the dust chamber cannot latch in, as a result of which the incorrect operation of the vacuum cleaner with ineffective dust collection is virtually ruled out. According to this aspect of the invention, the filter stop reliably blocks closure of the cover of the dust chamber as soon as the filter stop is located outside the first stop position and, in particular, in its second stop position.

The filter stop preferably has at least two latching elements that engage in a releasable manner with a mount in the housing of the vacuum cleaner and/or with a shoulder on the reinforcement plate of the dust bag. This ensures both reliable guidance of the filter stop and reliable mechanical interaction with the dust bag and the cover of the dust chamber.

One embodiment of the filter stop provides that the dust bag can only be removed if the first latching element or the second latching element is unlocked manually. It is thus possible to check the correct operation of the filter stop at any time. Since the dust bag can only be removed by manual unlocking of one of the latching elements, it is possible to check, during each removal, whether the filter stop is operative. In the case of a further embodiment of the filter stop according to the invention, the filter stop can only be removed if the second latching element is unlocked manually, which results in monitoring of the correct functioning of the filter stop being ensured at all times.

In an advantageous further configuration, the filter stop may be configured such that the pivoting lever of the filter stop is connected to a switch that only releases the vacuuming function of the vacuum cleaner when the dust bag is positioned correctly. This is associated with the advantage that operation of the vacuum cleaner without the dust bag, or with the dust bag positioned incorrectly, can be reliably ruled out. The switch, which prevents or allows the vacuuming function, may be, for example, a mechanically actuated electric switch. Also suitable as an alternative is an optical sensor, which may supply an electric switching signal. Such switches can be used to block the vacuuming function of the vacuum cleaner reliably as soon as the dust bag is absent or else has just been pushed in incorrectly. Other configurations of the switch, for example magnetic switches or reed switches or the like, are basically also suitable.

A further configuration according to the invention provides that the first latching element is a first latching hook that is brought into engagement with the first shoulder on the reinforcement plate. The second latching element is preferably a second latching hook that is brought into engagement with a corresponding second shoulder in the housing. The dust bag can thus latch in reliably and, in the correctly positioned state, ensures corresponding deflection of the pivoting lever.

The filter stop preferably is formed of an elastic polymer material, for example polyamide. Also suitable, in addition to a thermoplastic material, is a thermoset material which, in addition to the desired strength, has the elastic properties required.

One embodiment according to the invention provides that, if the reinforcement plate of the dust bag located in the correct installation position has been pushed all the way in, the pivoting lever is pushed, by a third shoulder in the housing, into a position in which the vacuuming function of the vacuum cleaner is allowed, the first latching hook engaging with the first shoulder. The dust bag then cannot slip during operation and ensures the deflection of the pivoting lever, which thus releases the suction operation of the vacuum cleaner.

It may further be provided that, with the reinforcement plate pushed part of the way out of the correct installation position, the displaceable filter stop is pushed, by the first latching hook, which engages with the first shoulder, into a position in which the second latching hook engages with the second shoulder, the pivoting lever, at the same time, being located in a position in which the vacuuming function of the vacuum cleaner is prevented. The dust bag thus still cannot be removed; it has to be first mechanically unlocked. Nevertheless, the vacuuming function of the vacuum cleaner is blocked even in this position, in order to prevent damage to the suction motor as a result of solids and dirt flowing past the filter bag.

The invention is also concerned with a dust bag with a reinforcement plate for use in a vacuum cleaner with the above-described filter stop. In the case of such a dust bag, the reinforcement plate has a shoulder that interacts with a pivoting lever of the filter stop.

Other features which are considered as characteristic for the invention are set forth in the appended claims.

Although the invention is illustrated and described herein as embodied in a filter stop for a vacuum cleaner, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2A is a rear, oblique plan view of the filter stop according to the invention from FIG. 1;

FIG. 2B is a front, plan view of the filter stop according to the invention from FIG. 1;

FIG. 3A is a sectional view of the filter stop taken along the line IIIA—IIIA shown in FIG. 3B;

FIGS. 3B is a rear, plan view of the filter stop according to the invention.

DESCRIPTION OF THE PREFERRED EMBODIMENTS

Figure 1:
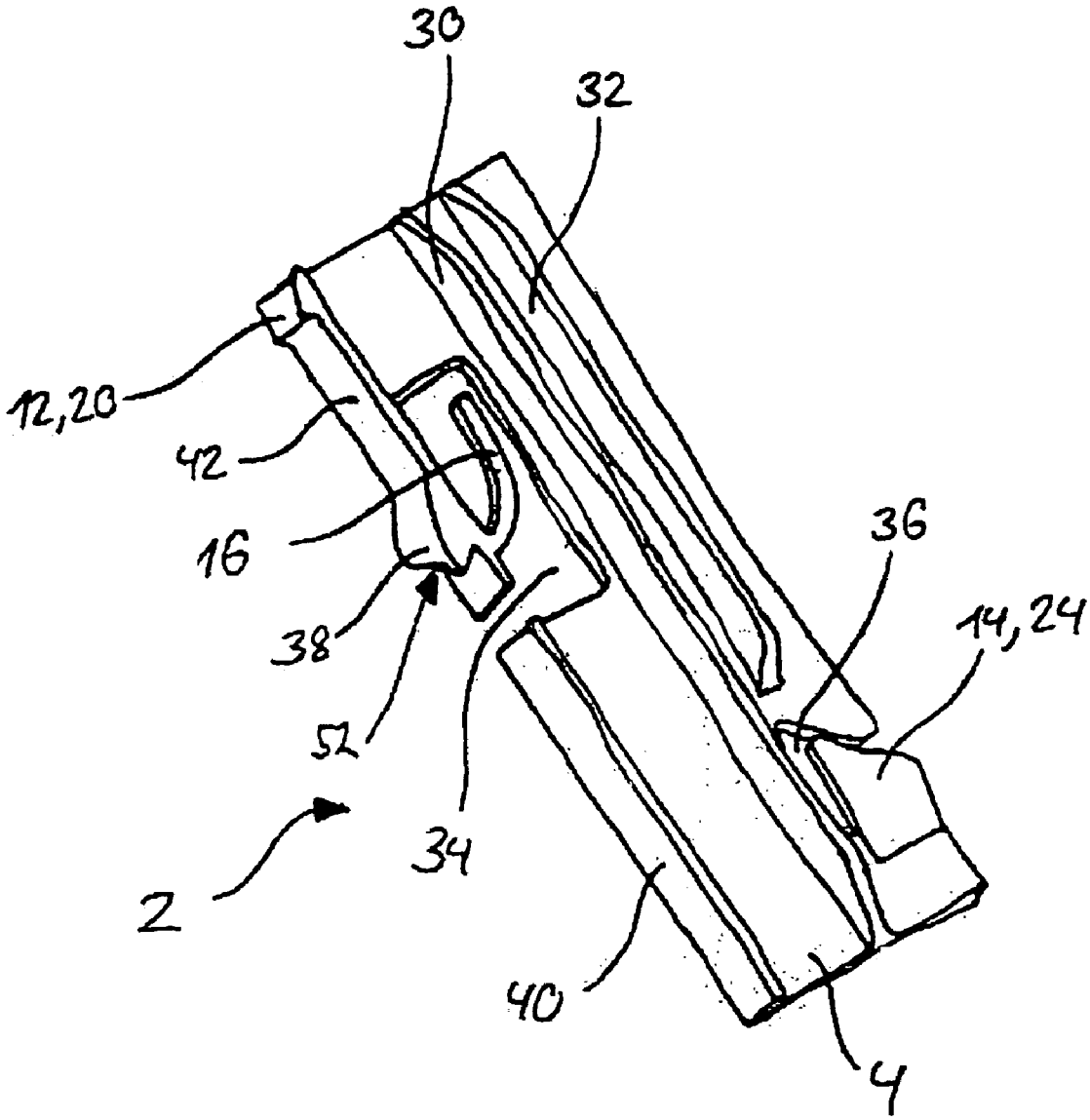
FIG. 1 is a diagrammatic, perspective view of a filter stop for a vacuum cleaner according to the invention.

Referring now to the figures of the drawing in detail and first, particularly, to FIG. 1 thereof, there is shown a perspective schematic illustration of a filter stop 2 according to the invention for a vacuum cleaner. The filter stop 2 contains a substantially rectangular base plate 4 which has an approximately central first longitudinal rib 30 which extends from one narrow side to the opposite narrow side of the base plate 4. A second longitudinal rib 32 extends from one narrow side of the base plate 4 over a length of approximately two thirds of the longitudinal side of the latter. The two longitudinal ribs 30, 32 each have shallow bevels at their ends and have a height which corresponds approximately to 20% to 30% of the width of the base plate 4. The longitudinal ribs 30, 32 serve predominantly for reinforcing the base plate 4 and, otherwise, have no significant further function. The length of the narrow sides of the base plate 4 corresponds approximately to 25% to 30% of the length of the longitudinal sides. Typical dimensions for the base plate 4 of the filter stop 2 may be, for example, approximately 15 to 20 mm for a narrow side and approximately 50 to 60 mm for a longitudinal side.

Provided on one longitudinal side of the base plate 4, furthermore, is a sidewall which is subdivided into a first sidewall section 40 and a second sidewall section 42. The sidewall is somewhat thicker than the longitudinal ribs 30, 32 and is interrupted at one location. Between the centrally disposed first longitudinal rib 30 and the sidewall, the base plate 4 has a first, rectangular cutout 34 which has one longitudinal side not quite adjacent to the first longitudinal rib 30 and, on its opposite longitudinal side, is fully adjacent to the second sidewall section 42. The first sidewall section 40 terminates level with a bottom narrow side of the first cutout 34. The top narrow side of the latter terminates some way above the center of the second sidewall section 42.

The second sidewall section 42 is freely suspended along the longitudinal side of the first cutout 34 and thus forms a resilient pivoting lever 52. The pivoting lever 52, furthermore, on an outer side which is directed away from the base plate 4, has an oblique stub 38, which has a curved resilient clip 16 disposed on its opposite side. The resilient clip 16, which projects more or less perpendicularly from the inside of the second sidewall section 42 and/or of the pivoting lever 52, describes a curved contour within the first cutout 34 and terminates shortly the top narrow side of the latter.

By virtue of the first cutout 34, which is directly adjacent to the second sidewall section 42, the second sidewall section 42, which forms the pivoting lever 52, is flexible over this length and can be bent relatively easily inward in the direction of the first-cutout 34, as a result of which the resilient clip 16 is likewise bent inward in the direction of the first longitudinal rib 30.

A first latching element 12 in the form of a nose-shaped first latching hook 20 is provided at the top end of the second sidewall section 42. The latching hook 20 has a small surface perpendicular to the second sidewall section 42 and a larger, inclined surface in the direction of the top narrow side of the base plate 4. The small surface of the first latching hook 20 is suitable for engaging with a first shoulder of the reinforcement plate of the dust bag, the first shoulder being described in more detail in FIGS. 4 to 6.

Finally, a second cutout 36 is provided in the base plate 4 beneath the second longitudinal rib 32, in the vicinity of the bottom narrow side. The second cutout 36 has a contour that is partly rectilinear, parallel to the first longitudinal rib 30, and partly oblique and meeting up with the right-hand longitudinal side of the base plate 4 with an acute angle of approximately 30 to 60°. Provided within the second cutout 36 is a slightly obliquely upwardly projecting, second latching element 14, which, as a second latching hook 24, interacts with a second shoulder in the housing, the shoulder being illustrated in more detail in FIGS. 4 to 6.

The filter stop 2 may preferably be configured in one piece and may advantageously be produced by injection molding from thermoplastic or thermoset material. Particularly suitable material for this purpose is polyamide, which lends itself well to processing and, in the cured state, has a high level of mechanical stability with, at the same time, sufficient elasticity.

FIGS. 2A and 2B each show schematic plan views of the filter stop 2 as in FIG. 1. FIG. 2A shows a view of the base plate 4 as seen obliquely from beneath. It is possible to see here, on the left-hand side, the second longitudinal rib 32, by which the first longitudinal rib 30 is virtually completely concealed. It is also possible to see the contours of the second cutout 36 and of the second latching element 14 disposed therein. FIG. 2B shows essentially the same parts as have already been described with reference to FIG. 1. This slightly inclined plan view illustrates the longitudinal ribs 30, 32 obliquely.

FIG. 3A is a cross-sectional view taken along the line IIIA—IIIA from FIG. 3B, which shows a plan view from beneath of the base plate 4 on the filter stop 2. The details which-can be seen in FIG. 3B have already been described with reference to FIG. 1. FIG. 3A illustrates the precise contours of the base plate 4, with the longitudinal ribs 30, 32 disposed perpendicularly thereto and with the side wall with its two side-wall sections 40, 42 disposed slightly obliquely in relation to the ribs.

Figure 4:
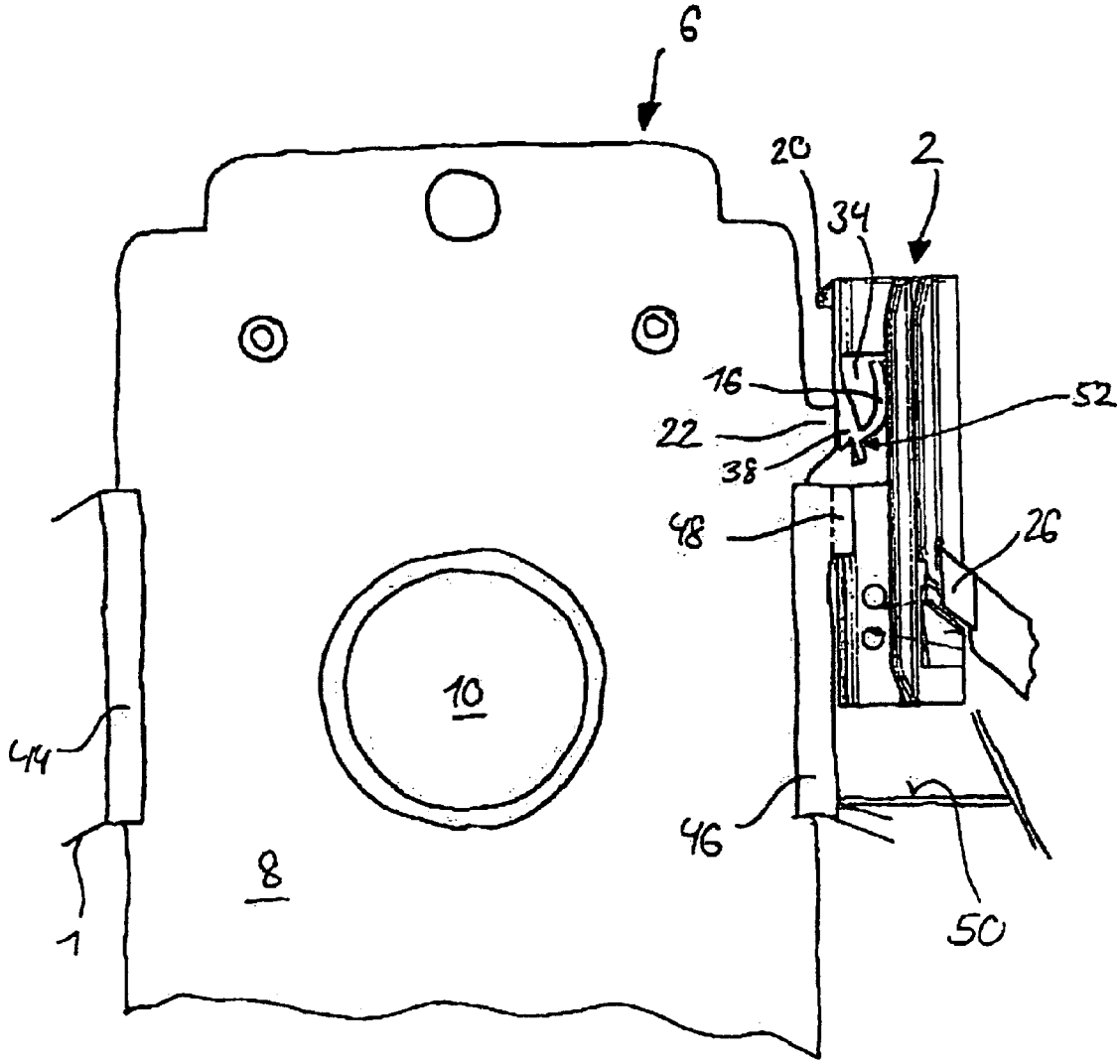
FIGS. 4 to 6 are diagrammatic illustrations of the filter stop in an installed state interacting with a reinforcement plate of a dust bag.

FIG. 4 shows a schematic illustration of the filter stop 2 in the installed state interacting with a reinforcement plate 8 of a dust bag 6 that is used in the housing 1 of a vacuum cleaner. Such a reinforcement plate 8 may be formed, for example, of relatively stable cardboard or else of a slightly flexible sheet of polymer material. The reinforcement plate 8 is retained by a guide rail 44, 46 of the housing 1, in each case on its two longitudinal sides and, if required, can be drawn out upward and thus removed from its installation location. The filter stop 2 is pushed in to the right of the second guide rail 46, the filter stop 2 having its sidewall sections 40, 42 butting against the second guide rail 46 and being retained essentially by a protrusion 48 of the second guide rail, the protrusion 48 gripping over the sidewall sections 40, 42.

In the illustration shown in FIG. 4, the dust bag 6 has been pushed all the way in, with the result that the central opening in the reinforcement plate 8 here is completely aligned with an intake opening 10 of the vacuum cleaner. The filter stop 2, in contrast, has not yet been pushed all the way in, and its bottom narrow side is not yet butting against a bottom stop 50 of the housing 1. On the right-hand longitudinal side of the filter stop 2, it is possible to see a second shoulder 26, which grips over the base plate 4, can interact with the second latching hook 24 of the filter stop 2, and, by butting against the same, can prevent the filter stop 2 being drawn out upwards. In the illustration shown, the filter stop 2 has been pushed downward precisely to the extent where the second latching hook 24, which is pushed resiliently downward by the second shoulder 26, has been released again and is relieved of stressing.

The filter stop 2 is thus located in its second stop position II, in which the vacuuming function of the vacuum cleaner is blocked. This is essentially achieved in that part of the cover of the dust chamber strikes against a top section of the filter stop 2 (for example on the base plate 4 in the vicinity of the top narrow side) and is thus prevented from closing or from latching in.

On its right-hand longitudinal side, the reinforcement plate 8 has a first shoulder 22 which, in the position of the filter stop 2 which is shown, pushes against the stub 38 on the pivoting lever 52 of the second sidewall section 42 and thus pushes the resilient clip 16 inward into the first cutout 34. In this position of the pivoting lever 52, the filter stop 2 can be pushed downward, without obstruction, into its first stop position I (see FIG. 5), as a result of which the vacuuming function of the vacuum cleaner is allowed since, in this position of the filter stop 2, the cover cannot latch in without obstruction.

Figure 5:
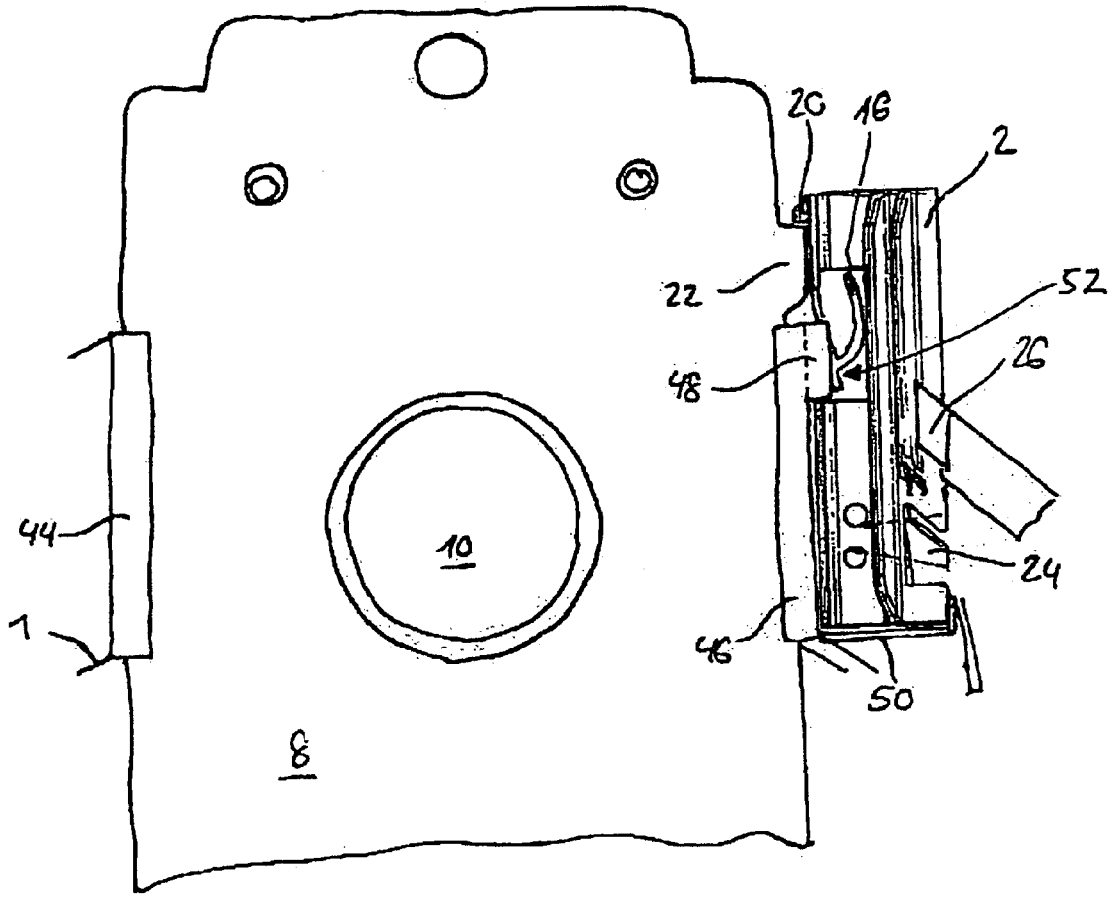

FIG. 5 illustrates the operating position of the vacuum cleaner with the dust bag 6 pushed all the way in and the filter stop 2 pushed in against the bottom stop 50 of the housing 1 (first stop position I), the pivoting lever 52 here having been pushed to the right and a vacuuming function of the vacuum cleaner having been released or allowed in that the cover of the dust chamber can latch in. In this position, the first latching hook 20 on the top edge of the second sidewall section 42 butts against the top edge of the first shoulder 22 of the reinforcement plate 8. The second shoulder 26 is spaced apart from the second latching hook 24.

Figure 6:
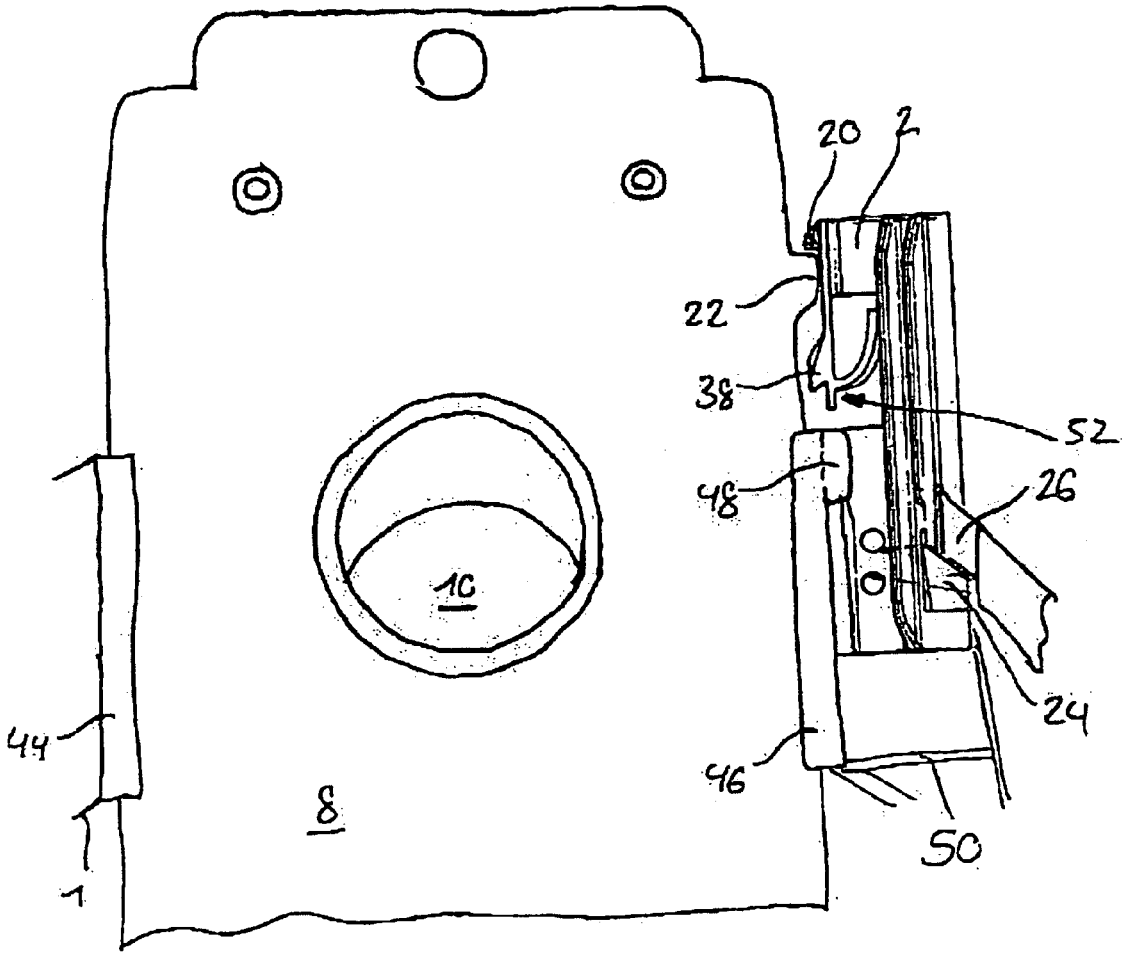

Finally, FIG. 6 shows a dust bag 6 that has been drawn upward out of its correct installation position, which can be seen from the fact that the intake opening 10 of the vacuum cleaner is not aligned with the round opening in the reinforcement plate 8. The reinforcement plate 8, at the same time, is located at its top stop, via which it can only be withdrawn from the filter stop 2 by manual release. For this purpose, the filter stop 2 or the reinforcement plate 8 has to be bent elastically, and with the result that the first shoulder 22 of the reinforcement plate 8 can be released from the first latching hook 20 of the filter stop 2. The filter stop 2 itself, which in this illustration is located, once again, in its second stop position II, can only be removed upward by the second latching hook 24 being pushed downward, with the result that it can slide through beneath the second shoulder 26.

In the position shown, the second latching hook 24 of the filter stop 2 butts against the second shoulder 26 of the housing 1 and thus cannot slide further upward. The first shoulder 22 of the reinforcement plate 8 of the dust bag 6, in turn, butts against the first latching hook 20 of the filter stop 2, with the result that it is not possible either for the dust bag to be moved further upward. The stub 38 is completely free in this position, with the result that the pivoting lever 52 and the resilient clip 16 are also located in the position in which they are relieved of stressing. The vacuuming function of the vacuum cleaner is prevented. This reliably prevents the vacuum cleaner from being able to operate in the case of an incorrectly positioned or absent dust bag 6. The correct installation position of the dust bag is ensured, furthermore, in that the filter stop 2 has to be pushed manually downward against the stop 50 after the dust bag 6 has been changed in each case.

The invention is not restricted to the preferred exemplary embodiments specified above. Rather, a number of variants that make use of the solution illustrated, even in the case of basically different types of configuration, are conceivable.

We claim:

1. A filter stop for a vacuum cleaner having a dust chamber which can be closed by a cover and intended for accommodating a dust-retention device with a reinforcement plate in a defined installation position, the filter stop comprising:

a base plate to be displaced between two stop positions, parallel to a pushing-in direction of the reinforcement plate of the dust-retention device, said base plate having a pivoting lever, said pivoting lever can be pivoted, by a shoulder of the reinforcement plate of the dust-retention device disposed at a correct installation position, into a first stop position of the two stop positions, which allows a vacuuming-function-releasing stop position of said base plate to be reached, and, with the dust-retention device disposed outside the correct installation position, said pivoting lever is disposed in a position which prevents the first stop position of said base plate from being reached.

2. The filter stop according to claim 1, wherein the filter stop is in combination with the vacuum cleaner, and the dust-retention device is selected from the group consisting of a dust bag and a cyclone.

3. The filter stop according to claim 1, wherein if the dust-retention device is absent or the reinforcement plate has not been pushed all the way in, the filter stop is blocked in a second stop position, in which a vacuuming function is prevented.

4. The filter stop according to claim 1, wherein only when said base plate is in the first stop position will the filter stop allow the cover of the dust chamber to be closed.

5. The filter stop according to claim 1, wherein outside the first stop position and, in a second stop position, the filter stop blocks closure of the cover of the dust chamber.

6. The filter stop according to claim 1, further comprising at least two latching elements extending from said base plate and engage in a releasable manner with a mount in a housing of the vacuum cleaner and/or the shoulder on the reinforcement plate of the dust-retention device.

7. The filter stop according to claim 6, wherein the dust-retention device can only be removed if one of said two latching elements is unlocked manually.

8. The filter stop according to claim 6, wherein said two latching elements include a first latching element and a second latching element, said first latching element being a first latching hook which is brought into engagement with the shoulder on the reinforcement plate.

9. The filter stop according to claim 8, wherein when the reinforcement plate is drawn out of the correct installation position by the shoulder, which engages with the first latching element, said base plate can be displaced out of the first stop position into a second stop position.

10. The filter stop according to claim 8, wherein said second latching element is a second latching hook brought into engagement with a corresponding further shoulder in the housing of the vacuum cleaner.

11. The filter stop according to claim 1, wherein the filter stop is formed of an elastic polymer material.

12. The filter stop according to claim 10, wherein with the reinforcement plate pushed part of a way out of the correct installation position, the filter stop is pushed, by said first latching hook, which engages with the shoulder, into a stop position in which said second latching hook engages with the further shoulder, said pivoting lever, at a same time, being located in a stop position in which the vacuuming function of the vacuum cleaner is prevented.

13. A filter stop for a vacuum cleaner having a dust chamber receiving a dust-retention device with a reinforcement plate in a correct installation position and a cover for closing the dust chamber, the filter stop comprising:

a base plate being movable between a first stop position, in which the dust retention device is correctly positioned and the vacuum cleaner is operable, and a second stop position, in which the filter stop prevents the cover from closing the dust chamber; and a lever disposed along an edge of the base plate adjacent the reinforcing plate and being movable between an extended condition, in which the lever restricts movement of the base plate toward the first stop position, and a retracted condition, in which the lever permits movement of the base plate toward the first stop position, at least a portion of the reinforcement plate engaging the lever and moving the lever toward the retracted condition when the dust-retention device is in the correct installation position.

14. The filter stop according to claim 13, wherein the dust-retention device is received in the dust chamber in a linear pushing-in direction and the base plate is moveable in a translational direction being substantially parallel to the pushing-in direction.

15. The filter stop according to claim 13, wherein the lever includes a pivoting lever being pivotally movable between the extended condition and the retracted condition.

16. The filter stop according to claim 13, wherein the base plate includes a first hook disposed near an end of the base plate, at least a portion of the reinforcement plate engaging the first hook and moving the base plate toward the second stop position in response to the dust-retention device being removed from the dust chamber.

17. A vacuum cleaner comprising:

a housing defining a dust chamber and having a cover being movable between an open condition providing access to the dust chamber and a closed condition closing the dust chamber;

a guide rail supported by the housing and disposed within the dust chamber;

a dust-retention device having a reinforcement plate being received by the guide rail in a pushing-in direction, the reinforcing plate having a shoulder projecting outwardly from the reinforcing plate; and a filter stop supported by the housing for movement between a first stop position, in which the dust retention device is correctly positioned and the vacuum cleaner is operable, and a second stop position, in which the filter stop prevents the cover from being in the closed condition, the filter stop including a lever disposed along an edge of the filter stop adjacent the reinforcing plate and being movable between an extended condition, in which the lever restricts movement of the filter stop toward the first stop position, and a retracted condition, in which the lever permits movement of the filter stop toward the first stop position, the shoulder engaging the lever and moving the lever toward the retracted condition when the dust-retention device is in a correct installation position.

18. The vacuum cleaner according to claim 17, wherein the reinforcement plate is received by the guide rail in a linear pushing-in direction and the filter stop is supported by the housing for translational movement in a direction being substantially parallel to the pushing-in direction.

19. The vacuum cleaner according to claim 17, wherein the lever includes a pivoting lever being pivotally movable between the extended condition and the retracted condition.

20. The vacuum cleaner according to claim 17, wherein the filter stop includes a first hook disposed near an end of the filter stop, the shoulder engaging the first hook and moving the filter stop toward the second stop position in response to the dust retention device being removed from the housing.

21. The vacuum cleaner according to claim 20, wherein the filter stop includes a second hook disposed near an opposing end of the filter stop opposite the first hook and the housing includes a second shoulder engaging the second hook and limiting movement of the filter stop toward the second stop position.

22. The vacuum cleaner according to claim 17, wherein the vacuum cleaner includes intake opening, the reinforcement plate defining an aperture being aligned with the intake opening when the dust-retention device is in the correct installation position.

* * * * *